US006623854B2

(12) United States Patent
Bond

(10) Patent No.: US 6,623,854 B2
(45) Date of Patent: Sep. 23, 2003

(54) HIGH ELONGATION MULTICOMPONENT FIBERS COMPRISING STARCH AND POLYMERS

(75) Inventor: Eric Bryan Bond, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/294,442

(22) Filed: Nov. 14, 2002

(65) Prior Publication Data

US 2003/0091808 A1 May 15, 2003

Related U.S. Application Data

(63) Continuation-in-part of application No. 09/853,131, filed on May 10, 2001, and a continuation-in-part of application No. 09/852,888, filed on May 10, 2001.

(51) Int. Cl.[7] ..... D02G 8/00

(52) U.S. Cl. ..... 428/370; 428/373; 428/374; 428/372

(58) Field of Search ..... 428/370, 373, 428/374, 372

(56) References Cited

U.S. PATENT DOCUMENTS

| | | | |
|---|---|---|---|
| 4,139,699 | A | 2/1979 | Hernandez et al. |
| 4,853,168 | A | 8/1989 | Eden et al. |

(List continued on next page.)

FOREIGN PATENT DOCUMENTS

| | | |
|---|---|---|
| EP | 1035163 | 9/2000 |
| EP | 1035239 | 9/2000 |
| EP | 1217106 | 6/2002 |
| EP | 1217107 | 6/2002 |
| GB | 1 247 474 | 9/1971 |
| JP | 62028410 | 2/1987 |
| JP | 04100913 | 4/1992 |
| JP | 8027627 | 1/1996 |
| JP | 9041224 | 2/1997 |
| JP | 9276331 | 10/1997 |
| JP | 10008364 | 1/1998 |
| WO | WO 01/46506 A2 | 6/2001 |
| WO | WO 01/48078 A1 | 7/2001 |
| WO | WO 01/49912 A1 | 7/2001 |

OTHER PUBLICATIONS

Fringant, C., et al., "Preparation of Mixed Esters of Starch or Use of an External Plasticizer: Two Different Ways to Change the Properties of Starch Acetate Films", Carbohydrate Polymers 35 (1998) 97–106, Elsevier Science, Ltd.

Glenn, G. M., et al., "Starch, Fiber and $CaCO_3$ Effects on the Physical Properties of Foams Made by a Baking Process," Industrial Crops and Products 14 (2001) 201–212, Elsevier Science, Ltd.

Jandura, P., et al., "Thermal Degradation Behavior of Cellulose Fibers Partially Esterified with Some Long Chain Organic Acids", Polymer Degradation and Stability 70 (2000) 387–394, Elsevier Science, Ltd.

*Primary Examiner*—N. Edwards
(74) *Attorney, Agent, or Firm*—Angela Marie Stone; Leonard W. Lewis

(57) ABSTRACT

A multicomponent fiber comprising one component comprising non-starch thermoplastic polymer and one component comprising a thermoplastic starch. The thermoplastic polymer component can surround the thermoplastic starch component. The thermoplastic starch can contain destructured starch and plasticizer. The multicomponent fiber has a greater elongation than a monocomponent thermoplastic fiber produced with the same thermoplastic polymer component materials and under the same processing conditions. Also provided are nonwoven webs and disposable articles comprising the multicomponent fibers.

20 Claims, 2 Drawing Sheets

U.S. PATENT DOCUMENTS 5,316,578 A 5/1994 Buehler et al.
5,417,679 A 5/1995 Toms et al.
5,422,387 A 6/1995 Toms et al.
5,425,987 A 6/1995 Shawyer et al.
5,516,815 A 5/1996 Buehler et al.
5,593,768 A 1/1997 Gessner
5,593,778 A 1/1997 Kondo et al.
5,703,160 A 12/1997 Dehennau et al.
5,814,404 A 9/1998 Rutherford et al.
5,851,937 A 12/1998 Wu et al.
5,874,486 A 2/1999 Bastioli et al.
5,945,480 A 8/1999 Wang et al.
5,985,776 A 11/1999 Bertrand et al.
6,045,908 A 4/2000 Nakajima et al.
6,096,809 A 8/2000 Lorcks et al.
6,117,925 A 9/2000 Tomka
6,218,321 B1 4/2001 Lorcks et al.
6,316,578 B1 11/2001 McCloskey et al.
6,376,072 B1 4/2002 Evans et al.
6,451,170 B1 9/2002 Anderson et al.

HIGH ELONGATION MULTICOMPONENT FIBERS COMPRISING STARCH AND POLYMERS

CROSS REFERENCE TO RELATED PATENTS

This application is a continuation-in-part and claims priority to co-pending and commonly owned U.S. application Ser. Nos. 09/853,131, pending and 09/852,888, pending, both filed May 10, 2001.

FIELD OF THE INVENTION

The present invention relates to multicomponent fibers comprising starch and polymers. The fibers will have high elongation and can be used to make nonwoven webs and disposable articles.

BACKGROUND OF THE INVENTION

There is a desire to provide low-cost fibers that have improved elongation or extensibility. There is also a desire to provide such fibers that incorporate polymer components derived from biorenewable resources. There is also a need for nonwovens that can deliver softness and extensibility. Nonwovens that are capable of high extensibility at relatively low force are also desired. These can be used to provide sustained fit in products and facilitate the use of various mechanical post-treatments. Typically, it has been found that extensibility is difficult to achieve without an increase in the expense of producing the fiber. Typical ways of increasing fiber extensibility include using high-cost materials and or special, often costly, mixing requirements.

There exists today an unmet need for extensible nonwovens that can be made with thermoplastic polymers. The present invention provides extensible fibers that can be cost-effective and easily processable. The fibers are made of a combination of starches and thermoplastic polymers. The starch and polymer composition is suitable for use in commercially available equipment used to make the multicomponent fibers.

SUMMARY OF THE INVENTION

The present invention is directed to multicomponent fibers. The multicomponent fibers will comprise a core component comprising thermoplastic starch which is encompassed by thermoplastic polymer component comprising a non-starch thermoplastic polymer. The configuration of the multicomponent fibers will be of a sheath-core configuration wherein the thermoplastic polymer component constitutes the sheath and the thermoplastic starch component constitutes the core component. The core component can have a single core, or two or more cores. The multicomponent fibers will have a greater elongation than the same thermoplastic monocomponent fibers produced under identical processing conditions.

The present invention is also directed to nonwoven webs and disposable articles comprising the multicomponent fibers. The nonwoven webs may also contain other synthetic or natural fibers blended with the fibers of the present invention.

BRIEF DESCRIPTION OF THE DRAWINGS

These and other features, aspects, and advantages of the present invention will become better understood with regard to the following description, appended claims, and accompanying drawings where:

FIG. 1A illustrates a concentric sheath-core configuration.

FIG. 1B illustrates a sheath-core configuration with a solid core and shaped continuous sheath.

FIG. 1C illustrates a sheath-core configuration with a hollow core and continuous sheath.

FIG. 1D illustrates a sheath-core configuration with a hollow core and shaped continuous sheath.

FIG. 1E illustrates an acentric sheath-core configuration.

FIG. 2A is a solid islands-in the-sea configuration.

FIG. 2B is an alternate solid islands-in the-sea configuration.

FIG. 2C is a hollow islands-in the-sea configuration.

DETAILED DESCRIPTION OF THE INVENTION

Figure 1A:
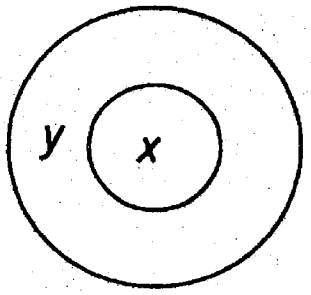
FIGS. 1A–1E are cross-sectional views of a bicomponent fiber having a sheath/core configuration.

All percentages, ratios and proportions used herein are by weight percent of the composition, unless otherwise specified. All average values are calculated "by weight" of the composition or components thereof, unless otherwise expressly indicated. "Average molecular weight", or "molecular weight" for polymers, unless otherwise indicated, refers to number average molecular weight. Number average molecular weight, unless otherwise specified, is determined by gel permeation chromatography. All patents or other publications cited herein are incorporated herein by reference with respect to all text contained therein for the purposes for which the reference was cited. Inclusion of any such patents or publications is not intended to be an admission that the cited reference is citable as prior art or that the subject matter therein is material prior art against the present invention. The compositions, products, and processes described herein may comprise, consist essentially of, or consist of any or all of the required and/or optional components, ingredients, compositions, or steps described herein.

The specification contains a detailed description of (1) materials of the present invention, (2) configuration of the multicomponent fibers, (3) material properties of the multicomponent fiber, (4) processes, and (5) articles.

(1) Materials

Component A: Thermoplastic Polymers

Suitable melting temperatures of the thermoplastic polymers, as well as the thermoplastic polymer component, are from about 60° C. to about 300° C., preferably from about 80° C. to about 250° C. and preferably from 100° C.–215° C. Thermoplastic polymers having a melting temperature (Tm) above 250° C. may be used if plasticizers or diluents or other polymers are used to lower the observed melting temperature, such that the melting temperature of the composition of the thermoplastic polymer-containing component is within the above ranges. It may be desired to use a thermoplastic polymer having a glass transition (Tg) temperature of less than 0° C. The thermoplastic polymer component has rheological characteristics suitable for melt spinning. The molecular weight of the polymer should be sufficiently high to enable entanglement between polymer molecules and yet low enough to be melt spinnable. For melt spinning, suitable thermoplastic polymers can have molecular weights about 1,000,000 g/mol or below, preferably from about 5,000 g/mol to about 800,000 g/mol, more preferable from about 10,000 g/mol to about 700,000 g/mol and most preferably from about 20,000 g/mol to about 500,000 g/mol.

The thermoplastic polymers desirably should be able to solidify fairly rapidly, preferably under extensional flow, as typically encountered in known processes for staple fibers (spin draw process), continuous filaments, or spunbond continuous filament processes, and desirably can form a thermally stable fiber structure. "Thermally stable fiber structure" as used herein is defined as not exhibiting significant melting or dimensional change at 25° C. and ambient atmospheric pressure over a period of 24 hours at 50% relative humidity when diameter is measured and the fibers are placed in the environment within five minutes of their formation. Dimensional changes in measured fiber diameter greater than 25% difference, using as a basis the corresponding, original fiber diameter measurement, would be considered significant. If the original fiber is not round, the shortest diameter should be used for the calculation. The shortest diameter should also be used for the 24 hour measurement also.

Suitable thermoplastic polymers include polyolefins such as polyethylene or copolymers thereof, including low, high, linear low, or ultra low density polyethylenes, polypropylene or copolymers thereof, including atactic polypropylene; polybutylene or copolymers thereof; polyamides or copolymers thereof, such as Nylon 6, Nylon 11, Nylon 12, Nylon 46, Nylon 66; polyesters or copolymers thereof, such as polyethylene terephthalates; olefin carboxylic acid copolymers such as ethylene/acrylic acid copolymer, ethylene/maleic acid copolymer, ethylene/methacrylic acid copolymer, ethylene/vinyl acetate copolymers or combinations thereof; polyacrylates, polymethacrylates, and their copolymers such as poly(methyl methacrylates). Other non-limiting examples of polymers include polycarbonates, polyvinyl acetates, poly(oxymethylene), styrene copolymers, polyacrylates, polymethacrylates, poly(methyl methacrylates), polystyrene/methyl methacrylate copolymers, polyetherimides, polysulfones, or combinations thereof. In some embodiments, thermoplastic polymers include polypropylene, polyethylene, polyamides, polyvinyl alcohol, ethylene acrylic acid, polyolefin carboxylic acid copolymers, polyesters, and combinations thereof.

Biodegradable thermoplastic polymers are also suitable for use herein. Biodegradable materials are susceptible to being assimilated by microorganisms such as molds, fungi, and bacteria when the biodegradable material is buried in the ground or otherwise comes in contact with the microorganisms including contact under environmental conditions conducive to the growth of the microorganisms. Suitable biodegradable polymers also include those biodegradable materials which are environmentally degradable using aerobic or anaerobic digestion procedures, or by virtue of being exposed to environmental elements such as sunlight, rain, moisture, wind, temperature, and the like. The biodegradable thermoplastic polymers can be used individually or as a combination of biodegradable or non-biodegradable polymers. Biodegradable polymers include polyesters containing aliphatic components. Among the polyesters are ester polycondensates containing aliphatic constituents and poly (hydroxycarboxylic) acid. The ester polycondensates include diacids/diol aliphatic polyesters such as polybutylene succinate, polybutylene succinate co-adipate, aliphatic/aromatic polyesters such as terpolymers made of butylenes diol, adipic acid and terephtalic acid. The poly (hydroxycarboxylic) acids include lactic acid based homopolymers and copolymers, polyhydroxybutyrate (PHB), or other polyhydroxyalkanoate homopolymers and copolymers. Such polyhydroxyalkanoates include copolymers of PHB with higher chain length monomers, such as C6–C12, and higher, polyhydroxyalkanaotes, such as disclosed in U.S. Pat. RE No. 36,548 and U.S. Pat. No. 5,990,271.

An example of a suitable commercially available poly lactic acid is NATUREWORKS from Cargill Dow and LACEA from Mitsui Chemical. An example of a suitable commercially available diacid/diol aliphatic polyester is the polybutylene succinate/adipate copolymers sold as BIONOLLE 1000 and BIONOLLE 3000 from the Showa Highpolymer Company, Ltd. Located in Tokyo, Japan. An example of a suitable commercially available aliphatic/aromatic copolyester is the poly(tetramethylene adipate-co-terephthalate) sold as EASTAR BIO Copolyester from Eastman Chemical or ECOFLEX from BASF.

The selection of the polymer and amount of polymer will effect the softness, texture, and properties of the final product as will be understood by those or ordinary skill in the art. The thermoplastic polymer component can contain a single polymer species or a blend of two or more non-starch thermoplastic polymers. Additionally, other materials, including but not limited to thermoplastic starch, can be present in the thermoplastic polymer component. Typically, non-starch, thermoplastic polymers are present in an amount of from about 51% to 100%, preferably from about 60% to about 95%, more preferably from about 70% to about 90%, by total weight of the thermoplastic polymer component.

The thermoplastic polymer component surrounds the lateral exterior sides of the starch component and can protect the starch component from ambient conditions which can include, but are not limited to, mechanical, thermodynamic, electrical, or solvent conditions, or combinations thereof. The thermoplastic polymer component can completely surrounds the lateral exterior sides of the thermoplastic starch component. The thermoplastic polymer component can also makes the fibers more functional as the fibers are more temperature stable, more resistant to solvents, and able to be thermally bonded.

Component B: Thermoplastic Starch The present invention relates to the use of starch, a low cost naturally occurring biopolymer. The starch used in the present invention is thermoplastic, destructured starch. The term "destructurized starch" is used to mean starch that is no longer in its naturally occurring granular structure. The term "thermoplastic starch" or "TPS" is used to mean starch with a plasticizer for improving its thermoplastic flow properties so that it may be able to be spun into fibers.

Natural starch does not melt or flow like conventional thermoplastic polymers. Since natural starch generally has a granular structure, it desirably should be "destructurized", or "destructured", before it can be melt processed and spun like a thermoplastic material. Without intending to be bound by theory, the granular structure of starch is characterized by granules comprising a structure of discrete amylopectin and amylose regions in a starch granule. This granular structure is broken down during destructurization, which can be followed by a volume expansion of the starch component in he presence of the solvent or plasticizer. Starch undergoing destructuring in the presence of the solvent or plasticizer also typically has an increase in viscosity versus non-destructured starch with the solvent or plasticizer. The resulting destructurized starch can be in gelatinized form or, upon drying and or annealing, in crystalline form, however once broken down the natural granular structure of starch will not, in general, return. It is desirable that the starch be fully destructured such that no lumps impacting the fiber spinning process are present. The destructuring agent used to destructure the starch may remain with the starch during further processing, or may be transient, in that it is removed such that it does not remain in the fiber spun with the starch.

Starch can be destructured in a variety of different ways. The starch can be destructurized with a solvent. For example, starch can be destructurized by subjecting a mixture of the starch and solvent to heat, which can be under pressurized conditions and shear, to gelatinize the starch, leading to destructurization. Solvents can also act as plasticizers and may be desirably retained in the composition to perform as a plasticizer during later processing. A variety of plasticizing agents that can act as solvents to destructure starch are described herein. These include the low molecular weight or monomeric plasticizers, such as but not limited to hydroxyl-containing plasticizers, including but not limited to the polyols, e.g. polyols such as mannitol, sorbitol, and glycerin. Water also can act as a solvent for starch, and can be used to destructurize the starch by dissolving it in water.

For starch to flow and be melt spinnable like a conventional thermoplastic polymer, it should have plasticizer present. If the destructuring agent is removed, it is the nature of the starch to in general remain destructured, however a plasticizer should be added to or otherwise included in the starch component to impart thermoplastic properties to the starch component in order to facilitate fiber spinning. Thus, the plasticizer present during spinning may be the same one used to destructure the starch. Alternately, especially when the destructuring agent is transient as described above, a separate or additional plasticizer may be added to the starch. Such additional plasticizer can be added prior to, during, or after the starch is destructured, as long as it remains in the starch for the fiber spinning step.

Suitable naturally occurring starches can include, but are not limited to, corn starch (e.g., waxy maize starch), potato starch, sweet potato starch, wheat starch, sago palm starch, tapioca starch, rice starch, soybean starch, arrow root starch, bracken starch, lotus starch, cassava starch, high amylose corn starch, and commercial amylose powder. Blends of starch may also be used. Though all starches are useful herein, the present invention is most commonly practiced with natural starches derived from agricultural sources, which offer the advantages of being abundant in supply, easily replenishable and inexpensive in price. Naturally occurring starches, particularly corn starch (including waxy maize starch), wheat starch, and potato starch, are starch polymers of choice due to their economy and availability.

Modified starch may also be used. Modified starch is defined as non-substituted, or substituted, starch that has had its native molecular weight characteristics changed (i.e. the molecular weight is changed but no other changes are necessarily made to the starch). Molecular weight can be modified, preferably reduced, by any technique numerous of which are well known in the art. These include, for example, chemical modifications of starch by, for example, acid or alkali hydrolysis, acid reduction, oxidative reduction, enzymatic reduction, physical/mechanical degradation (e.g., via the thermomechanical energy input of the processing equipment), or combinations thereof. The thermomechanical method and the oxidation method offer an additional advantage when carried out in situ. The exact chemical nature of the starch and molecular weight reduction method is not critical as long as the average molecular weight is provided at the desired level or range. Such techniques can also reduce molecular weight distribution.

Natural, unmodified starch generally has a very high average molecular weight and a broad molecular weight distribution (e.g. natural corn starch has an average molecular weight of up to about 60,000,000 grams/mole (g/mol)). It is desirable to reduce the molecular weight of the starch for use in the present invention. Molecular weight reduction can be obtained by any technique known in the art, including those discussed above. Ranges of molecular weight for destructured starch or starch blends added to the melt can be from about 3,000 g/mol to about 8,000,000 g/mol, preferably from about 10,000 g/mol to about 5,000,000 g/mol, and more preferably from about 20,000 g/mol to about 3,000,000 g/mol.

Optionally, substituted starch can be used. Chemical modifications of starch to provide substituted starch include, but are not limited to, etherification and esterification. For example, methyl, ethyl, or propyl (or larger aliphatic groups) can be substituted onto the starch using conventional etherification and esterification techniques as well known in the art. Such substitution can be done when the starch is in natural, granular form or after it has been destructured. Substitution can reduce the rate of biodegradability of the starch, but can also reduce the time, temperature, shear, and/or pressure conditions for destructurization. The degree of substitution of the chemically substituted starch is typically, but not necessarily, from about 0.01 to about 3.0, and can also be from about 0.01 to about 0.06.

Typically, the thermoplastic starch comprises from about 51% to about 100%, preferably from about 60% to about 95%, more preferably from about 70% to about 90% by weight of the thermoplastic starch component. The ratio of the starch component to the thermoplastic polymer will determine the percent of thermoplastic starch in the bicomponent fiber component. The weight of starch in the composition includes starch and its naturally occurring bound water content. The term "bound water" means the water found naturally occurring in starch and before mixing of starch with other components to make the composition of the present invention. The term "free water" means the water that is added in making the composition of the present invention. A person of ordinary skill in the art would recognize that once the components are mixed in a composition, water can no longer be distinguished by its origin. Natural starch typically has a bound water content of about 5% to about 16% by weight of starch.

Plasticizer

One or more plasticizers can be used in the present invention to destructurize the starch and enable the starch to flow, i.e. create a thermoplastic starch. As discussed above, a plasticizer may be used as a destructuring agent for the starch. That plasticizer may remain in the destructured starch component to function as a plasticizer for the thermoplastic starch, or may be removed and substituted with a different plasticizer in the thermoplastic starch component. The plasticizers may also improve the flexibility of the final products, which is believed to be due to the lowering of the glass transition temperature of the composition. A plasticizer or diluent for the thermoplastic polymer component may be present to lower the polymer's melting temperature, modify flexibility of the final product, or improve overall compatibility with the thermoplastic starch blend. Furthermore, thermoplastic polymers with higher melting temperatures may be used if plasticizers or diluents are present which suppress the melting temperature of the polymer.

In general, the plasticizers should be substantially compatible with the polymeric components of the present invention with which they are intermixed. As used herein, the term "substantially compatible" means when heated to a temperature above the softening and/or the melting temperature of the composition, the plasticizer is capable of forming a homogeneous mixture with polymer present in the component in which it is intermixed.

The plasticizers herein can include monomeric compounds and polymers. The polymeric plasticizers will typically have a molecular weight of about 100,000 g/mol or less. Polymeric plasticizers can include block copolymers and random copolymers, including terpolymers thereof. In certain embodiments, the plasticizer has a low molecular weight plasticizer, for example a molecular weight of about 20,000 g/mol or less, or about 5,000 g/mol or less, or about 1,000 g/mol or less. The plasticizers may be used alone or more than one plasticizer may be used in any particular component of the present invention.

The plasticizer can be, for example, an organic compound having at least one hydroxyl group, including polyols having two or more hydroxyls. Nonlimiting examples of useful hydroxyl plasticizers include sugars such as glucose, sucrose, fructose, raffinose, maltodextrose, galactose, xylose, maltose, lactose, mannose erythrose, and pentaerythritol; sugar alcohols such as erythritol, xylitol, malitol, mannitol and sorbitol; polyols such as glycerol (glycerin), ethylene glycol, propylene glycol, dipropylene glycol, butylene glycol, hexane triol, and the like, and polymers thereof; and mixtures thereof. Suitable plasticizers especially include glycerine, mannitol, and sorbitol.

Also useful herein hydroxyl polymeric plasticizers such as poloxomers (polyoxyethylene/polyoxypropylene block copolymers) and poloxamines (polyoxyethylene/polyoxypropylene block copolymers of ethylene diamine). These copolymers are available as Pluronic® from BASF Corp., Parsippany, N.J. Suitable poloxamers and poloxamines are available as Synperonic® from ICI Chemicals, Wilmington, Del., or as Tetronic® from BASF Corp., Parsippany, N.J.

Also suitable for use herein are hydrogen bond forming organic compounds, including those which do not have hydroxyl group, including urea and urea derivatives; anhydrides of sugar alcohols such as sorbitan; animal proteins such as gelatin; vegetable proteins such as sunflower protein, soybean proteins, cotton seed proteins; and mixtures thereof. Other suitable plasticizers are phthalate esters, dimethyl and diethylsuccinate and related esters, glycerol triacetate, glycerol mono and diacetates, glycerol mono, di, and tripropionates, butanoates, stearates, lactic acid esters, citric acid esters, adipic acid esters, stearic acid esters, oleic acid esters, and other father acid esters which are biodegradable. Aliphatic acids such as ethylene acrylic acid, ethylene maleic acid, butadiene acrylic acid, butadiene maleic acid, propylene acrylic acid, propylene maleic acid, and other hydrocarbon based acids.

The amount of plasticizer is dependent upon the molecular weight and amount of starch and the affinity of the plasticizer for the starch or thermoplastic polymer. Any amount that effectively plasticizes the polymer component can be used. The plasticizer should sufficiently plasticize the starch component so that it can be processed effectively to form fibers. Generally, the amount of plasticizer increases with increasing molecular weight of starch. Typically, the plasticizer can be present in an amount of from about 2% to about 70%, and can also be from about 5% to about 55% or from about 10% to about 50% of the component into which it is intermixed. Polymeric incorporated into the starch component that function as plasticizers for the starch shall be counted as part of the plasticizer constituent of that component of the present invention. Plasticizer is optional for the thermoplastic polymer components in the present invention, and zero percent or amounts below 2% are not meant to be excluded.

Optional Materials

Optionally, other ingredients may be incorporated into the thermoplastic starch and thermoplastic polymer composition. These optional ingredients may be present in quantities of about 49% or less, or from about 0.1% to about 30%, or from about 0.1% to about 10% by weight of the component. The optional materials may be used to modify the processability and/or to modify physical properties such as elasticity, tensile strength and modulus of the final product. Other benefits include, but are not limited to, stability including oxidative stability, brightness, color, flexibility, resiliency, workability, processing aids, viscosity modifiers, and odor control. A preferred processing aid is magnesium stearate. Another optional material that may be desired, particularly in the starch component, is ethylene acrylic acid, commercially available as Primacor by Dow. Examples of optional ingredients are found in U.S. application Ser. No. 09/853,131, herein incorporated by reference in its entirety.

(2) Configuration

The fibers of the present invention are, at least, bicomponent fibers. Component, as used herein, is defined as a separate part of the fiber that has a spatial relationship to another part of the fiber. The term multicomponent, as used herein, is defined as a fiber having more than one separate part in spatial relationship to one another. The term multicomponent includes bicomponent, which is defined as a fiber having two separate parts in a spatial relationship to one another. The different components of multicomponent fibers are arranged in substantially distinct regions across the cross-section of the fiber and extend continuously along the length of the fiber.

As described above, either or both of the required components may be multiconstituent components. Constituent, as used herein, is defined as meaning the chemical species of matter or the material. Multiconstituent fiber, as used herein, is defined to mean a fiber, or component thereof, containing more than one chemical species or material.

The multicomponent fibers of the present invention may be in any of several different configurations as long as the thermoplastic polymer component surrounds the starch component. The bicomponent fibers, for example, may be in an islands-in-the-sea configuration (a plurality of starch component cores surrounded by a thermoplastic polymer sheath) or a sheath-core configuration (a single starch component core surrounded by a thermoplastic polymer component sheath) wherein the starch component is completely surrounded by the thermoplastic polymer.

The multicomponent fibers may be in an islands-in-the-sea configuration or other sheath-core configurations wherein the starch is completely surrounded by, i.e. encompassed by, the thermoplastic polymer.

FIGS. 1A–1E are cross-sectional views of a bicomponent fiber having a sheath/core configuration. Component X is the starch component as it is always surrounded by Component Y, the thermoplastic polymer component.

FIG. 1A illustrates a concentric sheath-core configuration.

Figure 1B:
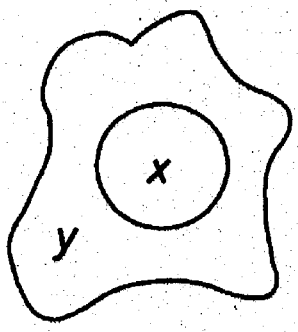

FIG. 1B illustrates a sheath-core configuration with a solid core and shaped continuous sheath.

Figure 1C:
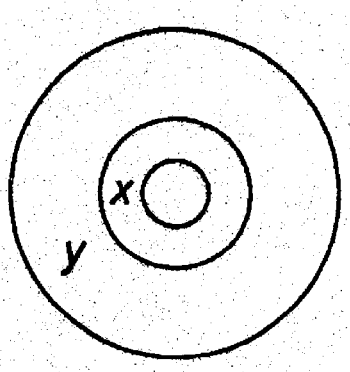

FIG. 1C illustrates a sheath-core configuration with a hollow core and continuous sheath.

Figure 1D:
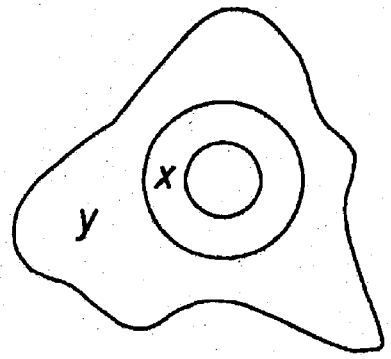

FIG. 1D illustrates a sheath-core configuration with a hollow core and shaped continuous sheath.

Figure 1E:
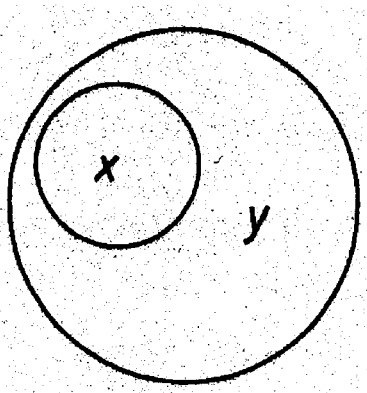

FIG. 1E illustrates an eccentric sheath-core configuration.

Figure 2A:
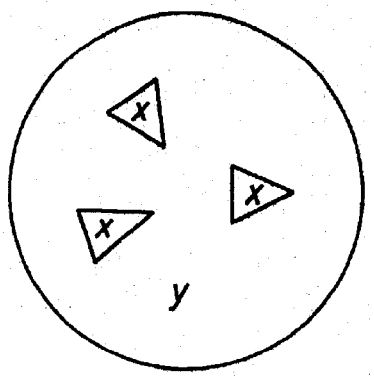
FIGS. 2A–2C are cross-sectional views of a bicomponent fiber having an islands-in-the-sea configuration.
Figure 2B:
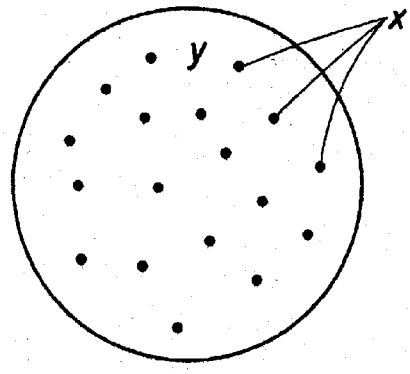
Figure 2C:
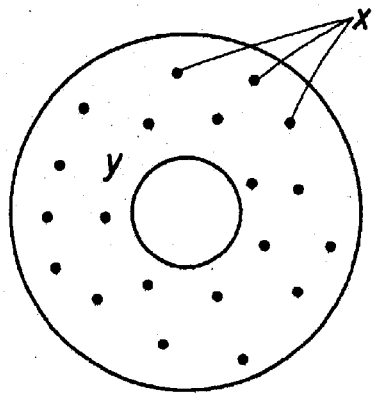

FIGS. 2A–2C are cross-sectional views of a bicomponent fiber having an islands-in-the-sea configuration.

FIG. 2A is a solid islands-in the-sea configuration with Component X being surrounded by Component Y. Component X is triangular in shape. FIG. 2B is a solid islands-in the-sea configuration with Component X being surrounded by Component Y. FIG. 2C is a hollow islands-in the-sea configuration with Component X being surrounded by Component Y.

The weight ratio of the thermoplastic starch component to thermoplastic polymer component can be from about 5:95 to about 95:5. In alternate embodiments, the ratio is from about 10:90 to about 65:35 and or from about 15:85 to about 50:50.

There may be any number of distinct segments of components to the multicomponent fibers flow through a single spinneret capillary during fiber making; typically, without limitation, the number of segments can range from 2 to about 2000, or alternately from 4 to about 400, or from 8 to about 164, or from about 16 to about 64.

(3) Material Properties

The diameter of the fiber of the present invention is typically less than about 200 micrometers (microns), and alternate embodiments can be less than about 100 microns, less than about 50 microns, or less than 30 microns. In one embodiment hereof, the fibers have a diameter of from about 5 microns to about 25 microns. Fiber diameter is controlled factors well known in the fiber spinning art including, for example, spinning speed and mass through-put.

The fibers produced in the present invention may be environmentally degradable depending upon the amount of starch that is present, the polymer used, and the specific configuration of the fiber. "Environmentally degradable" is defined being biodegradable, disintegratable, dispersible, flushable, or compostable or a combination thereof. In the present invention, the fibers, nonwoven webs, and articles may be environmentally degradable.

The fibers described herein are typically used to make disposable nonwoven articles. The articles are commonly flushable. The term "flushable" as used herein refers to materials which are capable of dissolving, dispersing, disintegrating, and/or decomposing in a septic disposal system such as a toilet to provide clearance when flushed down the toilet without clogging the toilet or any other sewage drainage pipe. The fibers and resulting articles may also be aqueous responsive. The term aqueous responsive as used herein means that when placed in water or flushed, an observable and measurable change will result. Typical observations include noting that the article swells, pulls apart, dissolves, or observing a general weakened structure.

The fibers of the present invention have enhanced extensibility or elongation. Extensibility or elongation is measured by elongation to break. Extensibility or elongation is defined as being capable of elongating under an applied force, but not necessarily recovering. Elongation to break is measured as the distance the fiber can be stretched until failure. The elongation to break of single fibers are tested according to ASTM standard D3822 except a strain rate of 200%/min is used. Testing is performed on an MTS Synergie 400 tensile testing machine with a 10 N load cell and pneumatic grips. Tests are conducted at a rate of 2 inches/minute on samples with a 1-inch gage length. Samples are pulled to break. Peak stress and % elongation at break are recorded and averaged for 10 specimens. The "Elongation to Break" of a fiber is defined as the elongation to break measured according to the above described test and conditions. The Elongation to Break Ratio of the fibers of the present invention is defined as the Elongation to Break of the multicomponent fibers of the present invention divided by the Elongation to Break of a monocomponent fiber made from the same composition as the thermoplastic polymer component, under otherwise essentially identical fiber spinning conditions and parameters. In particular, mass throughput, extrusion melt temperature for the thermoplastic polymer component, spinneret design, and spinning speed should be the same. The Elongation to Break Ratio for the multicomponent fibers of the present invention should be greater than 1.0, and can be about 1.5 or greater, or about 2.0 or greater.

The fibers of the present invention can have low brittleness and have high toughness, for example a toughness of about 2 MPa or greater. Toughness is defined as the area under the stress-strain curve.

Nonwoven products produced from the fibers of the present invention can also exhibit desirable mechanical properties, particularly, strength, flexibility, softness, and absorbency. Measures of strength include dry and/or wet tensile strength. Flexibility is related to stiffness and can attribute to softness. Softness is generally described as a physiologically perceived attribute which is related to both flexibility and texture. Absorbency relates to the products' ability to take up fluids as well as the capacity to retain them.

(4) Processes

The first step in producing a multicomponent fiber can be a compounding or mixing step. In the compounding step, the raw materials are heated, typically under shear. The shearing in the presence of heat will result in a homogeneous melt with proper selection of the composition. The melt is then placed in an extruder where fibers are formed. A collection of fibers is combined together using heat, pressure, chemical binder, mechanical entanglement, and combinations thereof resulting in the formation of a nonwoven web. The nonwoven is then assembled into an article.

Compounding

The objective of the compounding step is to produce a homogeneous melt composition for each component of the fibers. Preferably, the melt composition is homogeneous, meaning that a uniform distribution of ingredients in the melt is present. The resultant melt composition(s) should be essentially free of water to spin fibers. Essentially free is defined as not creating substantial problems, such as causing bubbles to form which may ultimately break the fiber while spinning. The free water content of the melt composition can be about 1% or less, about 0.5% or less, or about 0.15% of less. The total water content includes the bound and free water. Preferably, the total water content (including bound water and free water) is about 1% or less. To achieve this low water content, the starch or polymers may need to be dried before processed and/or a vacuum is applied during processing to remove any free water. The thermoplastic starch, or other components hereof, can be dried at elevated temperatures, such as about 60° C., before spinning. The drying temperature is determined by the chemical nature of a component's constituents. Therefore, different compositions can use different drying temperatures which can range from 20° C. to 150° C. and are, in general, below the melting temperature of the polymer. Drying of the components may, for example, be in series or as discrete steps combined with spinning. Such techniques for drying as are well known in the art can be used for purposes of this invention.

In general, any method known in the art or suitable for the purposes hereof can be used to combine the ingredients of the components of the present invention. Typically such techniques will include heat, mixing, and pressure. The particular order or mixing, temperatures, mixing speeds or time, and equipment can be varied, as will be understood by those skilled in the art, however temperature should be controlled such that the starch does not significantly degrade. The resulting melt should be homogeneous.

A suitable method of mixing for a starch and plasticizer blend is as follows:

1. The starch is destructured by addition of a plasticizer. The plasticizer, if solid such as sorbitol or mannitol, can be added with starch (in powder form) into a twin-screw extruder. Liquids such as glycerine can be combined with the starch via volumetric displacement pumps.
2. The starch is fully destructurized by application of heat and shear in the extruder. The starch and plasticizer mixture is typically heated to 120–180° C. over a period of from about 10 seconds to about 15 minutes, until the starch gelatinizes.
3. A vacuum can applied to the melt in the extruder, typically at least once, to remove free water. Vacuum can be applied, for example, approximately two-thirds of the way down the extruder length, or at any other point desired by the operator.
4. Alternatively, multiple feed zones can be used for introducing multiple plasticizers or blends of starch.
5. Alternatively, the starch can be premixed with a liquid plasticizer and pumped into the extruder.

As will be appreciated by one skilled in the art of compounding, numerous variations and alternate methods and conditions can be used for destructuring the starch and formation of the starch melt including, without limitation, via feed port location and screw extruder profile.

A suitable mixing device is a multiple mixing zone twin screw extruder with multiple injection points. The multiple injection points can be used to add the destructurized starch and the polymer. A twin screw batch mixer or a single screw extrusion system can also be used. As long as sufficient mixing and heating occurs, the particular equipment used is not critical.

An alternative method for compounding the materials comprises adding the plasticizer, starch, and polymer to an extrusion system where they are mixed in progressively increasing temperatures. For example, in a twin screw extruder with six heating zones, the first three zones may be heated to 90°, 120°, and 130° C., and the last three zones will be heated above the melting point of the polymer. This procedure results in minimal thermal degradation of the starch and for the starch to be fully destructured before intimate mixing with the thermoplastic materials.

An example of compounding destructured thermoplastic starch would be to use a Werner & Pfleiderer (30 mm diameter 40:1 length to diameter ratio) co-rotating twin-screw extruder set at 250 RPM with the first two heat zones set at 50° C. and the remaining five heating zones set 150° C. A vacuum is attached between the penultimate and last heat section pulling a vacuum of 10 atm. Starch powder and plasticizer (e.g., sorbitol) are individually fed into the feed throat at the base of the extruder, for example using mass-loss feeders, at a combined rate of 30 lbs/hour (13.6 kg/hour) at a 60/40 weight ratio of starch/plasticizer. Processing aids can be added along with the starch or plasticizer. For example, magnesium separate can be added, for example, at a level of 0–1%, by weight, of the thermoplastic starch component.

Spinning

The fibers of the present invention can be made by melt spinning. Melt spinning is differentiated from other spinning, such as wet or dry spinning from solution, where in such alternate methods a solvent is present in the melt and is eliminated by volatilizing or diffusing it out of the extrudate.

Spinning temperatures for the melts can range from about 105° C. to about 300° C., and in some embodiments can be from about 130° C. to about 230° C. or from about 150° C. to about 210° C. The processing temperature is determined by the chemical nature, molecular weights and concentration of each component.

In general, high fiber spinning rates are desired for the present invention. Fiber spinning speeds of about 10 meters/minute or greater can be used. In some embodiments hereof, the fiber spinning speed is from about 100 to about 7,000 meters/minute, or from about 300 to about 3,000 meters/minute, or from about 500 to about 2,000 meters/minute.

The fiber may be made by fiber spinning processes characterized by a high draw down ratio. The draw down ratio is defined as the ratio of the fiber at its maximum diameter (which is typically occurs immediately after exiting the capillary of the spinneret in a conventional spinning process) to the final diameter of the formed fiber. The fiber draw down ratio via either staple, spunbond, or meltblown process will typically be 1.5 or greater, and can be about 5 or greater, about 10 or greater, or about 12 or greater.

Continuous fibers can be produced through, for example, spunbond methods or meltblowing processes. Alternately, non-continuous (staple fibers) fibers can be produced according to conventional staple fiber processes as are well known in the art. The various methods of fiber manufacturing can also be combined to produce a combination technique, as will be understood by those skilled in the art. Hollow fibers, for example, can be produced as described in U.S. Pat. No. 6,368,990. Such methods as mentioned above for fiber spinning are well known and understood in the art.

The fibers spun can be collected subsequent for formation using conventional godet winding systems or through air drag attenuation devices. If the godet system is used, the fibers can be further oriented through post extrusion drawing at temperatures from about 50° to about 200° C. The drawn fibers may then be crimped and/or cut to form non-continuous fibers (staple fibers) used in a carding, airlaid, or fluidlaid process.

In the process of spinning fibers, particularly as the temperature is increased above 105° C., typically it is desirable for residual water levels to be 1%, by weight of the fiber, or less, alternately 0.5% or less, or 0.15% or less to be present in the various components.

Suitable multicomponent melt spinning equipment is described in U.S. Pat. No. 5,162,074, Hills, Inc.) and is commercially available from, for example, Hills Inc. located in Melbourne, Fla. USA.

The spinneret capillary dimensions can vary depending upon desired fiber size and design, spinning conditions, and polymer properties. Suitable capillary dimensions include, but are not limited to, length-to-diameter ratio of 4 with a diameter of 0.350 mm.

As will be understood by one skilled in the art, spinning of the fibers and compounding of the components can optionally be done in-line, with compounding, drying and spinning being a continuous process.

The residence time of each component in the spinline can have special significance when a high melting temperatures thermoplastic polymer is chosen to be spun with destructured starch. Spinning equipment can be designed to minimize the exposure of the destructured starch component to high process temperature by minimizing the time and volume of destructured exposed in the spinneret. For example, the polymer supply lines to the spinneret can be sealed and separated until introduction into the multicomponent pack. Furthermore, one skilled in the art of multicomponent fiber spinning will understand that the at least two components can be introduced and processed in their separate extruders at different temperatures until introduced into the spinneret.

For example, a suitable process for spinning a bicomponent islands-in-a-sea fiber with a destructured starch sea and polypropylene islands is as follows. The destructured starch component extruder profile may be 80° C., 150° C. and 150° C. in the first three zones of a three heater zone extruder with a starch composition similar to Example 1. The transfer lines and melt pump heater temperatures will also be 150° C. for the starch component. The polypropylene component extruder temperature profile would be 180° C., 230° C. and 230° C. in the first three zones of a three heater zone extruder. The transfer lines and melt pump are heated to 230° C. In this case the spinneret temperature can range from 180° C. to 230° C.

(5) Articles

The fibers hereof may be used for any purposes for which fibers are conventionally used. This includes, without limitation, incorporation into nonwoven substrates. The fibers hereof may be converted to nonwovens by any suitable methods known in the art. Continuous fibers can be formed into a web using industry standard spunbond type technologies while staple fibers can be formed into a web using industry standard carding, airlaid, or wetlaid technologies. Typical bonding methods include: calendar (pressure and heat), thru-air heat, mechanical entanglement, hydrodynamic entanglement, needle punching, and chemical bonding and/or resin bonding. The calendar, thru-air heat, and chemical bonding are the preferred bonding methods for the starch and polymer multicomponent fibers. Thermally bondable fibers are required for the pressurized heat and thru-air heat bonding methods.

The fibers of the present invention may also be bonded or combined with other synthetic or natural fibers to make nonwoven articles. The synthetic or natural fibers may be blended together in the forming process or used in discrete layers. Suitable synthetic fibers include fibers made from polypropylene, polyethylene, polyester, polyacrylates, and copolymers thereof and mixtures thereof. Natural fibers include cellulosic fibers and derivatives thereof. Suitable cellulosic fibers include those derived from any tree or vegetation, including hardwood fibers, softwood fibers, hemp, and cotton. Also included are fibers made from processed natural cellulosic resources such as rayon.

The fibers of the present invention may be used to make nonwovens, among other suitable articles. Nonwoven articles can contain, for example, 15% or greater, of a plurality of fibers that are continuous or non-continuous and physically and/or chemically attached to one another. The nonwoven may be in the form of a protective layer, a barrier layer, a liquid and/or air impervious layer, or an absorbent core or web. The nonwoven may be combined with additional nonwovens or films to produce a layered product used either by itself or as a component in a complex combination of other materials, such as a baby diaper or feminine care pad. A particular embodiment contemplated herein includes disposable, nonwoven articles. The resultant products may find use in one of many different uses. Suitable articles of the present invention include disposable nonwovens for hygiene, cleaning, surface treatment, and medical applications. Hygiene applications include such items as wipes; diapers, particularly the top sheet or back sheet or as a protective layer covering elastics of other components of the diaper; and feminine pads or products, particularly the top sheet.

EXAMPLES

The examples below further illustrate the present invention. The starches for use in the examples below are StarDri 1, StarDri 100, Ethylex 2015, or Ethylex 2035, all from Staley Chemical Co. The latter Staley materials are substituted starches. The polypropylenes (PP) are Basell Profax PH-835, Basell PDC 1298, or Exxon/Mobil Achieve 3854. The polyethylenes (PE) are Dow Chemicals Aspun 6811A, Dow Chemical Aspun 6830A, or Dow Chemical Aspun 6842A. The glycerine is from Dow Chemical Company, Kosher Grade BU OPTIM* Glycerine 99.7%. The sorbitol is from Archer-Daniels-Midland Co. (ADM), Crystalline NF/FCC 177440-2S. The polyethylene acrylic acid is PRIMACOR 5980-I from Dow Chemical Co. Other polymers having similar chemical compositions that differ in molecular weight, molecular weight distribution, and/or comonomer or defect level can also be used. The process condition in Comparative Example 1 and Examples 1–12 use a total mass through put of 0.8 ghm. The practical range of mass throughput is from about 0.1 to about 8 ghm.

Comparative Example 1

Solid polypropylene (PP) monocomponent fibers composed of Basell Profax PH-835 are prepared at a through-put of 0.8 grams per hole per minute (ghm) had an elongation-to-break of 181% when the fiber diameter was 18 $\mu$m when melt spun into fibers via a continuous filament process at a melt extrusion temperature of 190° C.

Example 1

Solid Sheath/Core Bicomponent Fiber (such as exemplified in FIG. 1A): Component A is Polypropylene (Basell Profax PH-835). Component B is the TPS component and is compounded using 60 parts StarDri 1, 40 parts sorbital, 15 parts Primacore 5980-I, and 1 part Magnesium Stearate (included in all starch formulations). The melt processing temperature is 190° C. Fibers are made at ratios of Component A to Component B of 10:90, 20:80, 30:70, and 50:50.

Example 2

Solid Sheath/Core Bicomponent Fiber (such as exemplified in FIG. 1A): Component A is Polyethylene. Component B is the TPS component and is compounded using 60 parts StarDri 1 and 40 parts sorbital. The melt processing temperature ranges from 150 to 190° C. The ratio of Component A to Component B is 95:5 to 20:80.

Example 3

Solid Sheath/Core Bicomponent Fiber (such as exemplified in FIG. 1A): Component A is PLA. Component B is the TPS component and is compounded using 60 parts StarDri 1 and 40 parts sorbital. The melt processing temperature ranges from 180 to 210° C. The ratio of Component A to Component B is 95:5 to 20:80.

Example 4

Solid Sheath/Core Bicomponent Fiber (such as exemplified in FIG. 1A): Component A is Eastman 14285. Component B is the TPS component and is compounded using 60 parts StarDri 1 and 40 parts sorbital. The melt processing temperature ranges from 210 to 250° C. The ratio of Component A to Component B is 95:5 to 20:80.

Example 5

Solid Sheath/Core Bicomponent Fiber (such as exemplified in FIG. 1A): Component A is Bionolle 1020. Component B is the TPS component and is compounded using 60 parts StarDri 1 and 40 parts sorbital. The melt processing temperature ranges from 160 to 200° C. The ratio of Component A to Component B is 95:5 to 20:80.

Example 6

Solid Sheath/Core Bicomponent Fiber (such as exemplified in FIG. 1A): Component A is EASTAR BIO. Component B is the TPS component and is compounded using 60 parts StarDri 1 and 40 parts sorbital. The melt processing temperature ranges from 150 to 180° C. The ratio of Component A to Component B is 95:5 to 20:80.

Example 7

Islands-in-the-Sea Bicomponent Fiber (Such as exemplified in FIG. 2B): Component A is Polypropylene. Component B is the TPS component and is compounded using 60 parts StarDri 1 and 40 parts sorbital. The melt processing temperature ranges from 180 to 210° C. The ratio of Component A to Component B is 95:5 to 30:70.

Example 8

Islands-in-the-Sea Bicomponent Fiber (Such as exemplified in FIG. 2B): Component A is Polyethylene. Component B is the TPS component and is compounded using 60 parts StarDri 1 and 40 parts sorbital. The melt processing temperature ranges from 150 to 190° C. The ratio of Component A to Component B is 95:5 to 30:70.

Example 9

Islands-in-the-Sea Bicomponent Fiber (Such as exemplified in FIG. 2B): Component A is PLA. Component B is the TPS component and is compounded using 60 parts StarDri 1 and 40 parts sorbital. The melt processing temperature ranges from 180 to 210° C. The ratio of Component A to Component B is 95:5 to 30:70.

Example 10

Islands-in-the-Sea Bicomponent Fiber (Such as exemplified in FIG. 2B): Component A is Eastman 14285. Component B is the TPS component and is compounded using 60 parts StarDri 1 and 40 parts sorbital. The melt processing temperature ranges from 210 to 250° C. The ratio of Component A to Component B is 95:5 to 30:70.

Example 11

Islands-in-the-Sea Bicomponent Fiber (Such as exemplified in FIG. 2B): Component A is Bionolle 1020. Component B is the TPS component and is compounded using 60 parts StarDri 1 and 40 parts sorbital. The melt processing temperature ranges from 160 to 200° C. The ratio of Component A to Component B is 95:5 to 30:70.

Example 12

Islands-in-the-Sea Bicomponent Fiber (Such as exemplified in FIG. 2B): Component A is EASTAR BIO. Component B is the TPS component and is compounded using 60 parts StarDri 1 and 40 parts sorbital. The melt processing temperature ranges from 150 to 180° C. The ratio of Component A to Component B is 95:5 to 30:70.

While particular examples are above, different combinations of materials, ratios, and equipment, such as but not limited to, counter rotating twin screw or high shear single screw with venting could also be used.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A multicomponent fiber comprising:

A. a thermoplastic polymer component comprising non-starch thermoplastic polymer;

B. a thermoplastic starch component;

wherein the multicomponent fiber has a greater elongation to break ratio of greater than 1.0.

2. The multicomponent fiber of claim 1 wherein the multicomponent fiber has a diameter of about 200 micrometers or less.

3. The multicomponent fiber of claim 2, said thermoplastic starch component having a lateral surface, wherein said thermoplastic polymer component encompasses said thermoplastic starch component.

4. The multicomponent fiber of claim 2, said thermoplastic starch component having a lateral surface, wherein said thermoplastic polymer component encompasses the lateral surface of said thermoplastic starch component.

5. The multicomponent fiber of claim 3 wherein the fiber has a sheath-core configuration with said thermoplastic polymer component being the sheath and said thermoplastic starch component being the core.

6. The multicomponent fiber of claim 5, wherein said sheath core configuration is selected from the group consisting of a single core configuration and a islands in the sea configuration.

7. The multicomponent fiber of claim 2, wherein said thermoplastic starch component comprises destructured starch and plasticizer.

8. The multicomponent fiber of claim 7, wherein said thermoplastic polymer component comprises about 51%, by weight of said component, of non-starch thermoplastic polymer or greater, and said thermoplastic starch component comprises about 51%, by weight of said component, of thermoplastic starch.

9. The multicomponent fiber of claim 1 wherein the multicomponent fiber is produced at a fiber spinning speed of 2000 meters per minute or less.

10. The multicomponent fiber of claim 7 wherein the ratio of Component B to Component A is from about 5:95 to about 95:5.

11. The multicomponent fiber of claim 7 wherein the non-starch thermoplastic polymer of Component A is selected from the group comprising of polypropylene, polypropylene copolymers polyethylene, polyethylene copolymers polyvinyl alcohol, ethylene acrylic acid, their copolymers, and combinations thereof.

12. The multicomponent fiber of claim 7 wherein Component A comprises up to about 49% thermoplastic starch.

13. A nonwoven web comprising the multicomponent fibers of claim 1.

14. The nonwoven web of claim 13 further comprising at least one type of monocomponent fibers intermixed with said multicomponent fibers, wherein said web is characterized by fiber to fiber bonding.

15. The nonwoven web of claim 14, wherein said fiber to fiber bonding includes thermoplastic polymer bonds between said fibers.

16. A disposable article comprising the nonwoven web of claim 13.

17. A disposable article comprising the nonwoven web of claim 14.

18. A disposable article comprising the nonwoven web of claim 15.

19. The multicomponent fiber of claim 1, wherein the Elongation to Break Ratio is about 1.5 or greater.

20. The multicomponent fiber of claim 19, wherein the Elongation to Break Ratio is about 2.0 or greater.

* * * * *